US006374761B1

(12) United States Patent
Dhellemmes

(10) Patent No.: US 6,374,761 B1
(45) Date of Patent: Apr. 23, 2002

(54) WATERTIGHT AND THERMALLY INSULATING TANK BUILT INTO THE BEARING STRUCTURE OF A SHIP

(75) Inventor: Jacques Dhellemmes, Versailles (FR)

(73) Assignee: Gaz Transport et Technigaz, Trappes (FR)

( * ) Notice: Subject to any disclaimer, the term of this patent is extended or adjusted under 35 U.S.C. 154(b) by 0 days.

(21) Appl. No.: 09/644,976

(22) Filed: Aug. 24, 2000

(30) Foreign Application Priority Data

Sep. 29, 1999 (FR) ..... 99 12118

(51) Int. Cl.[7] ..... B63B 25/08
(52) U.S. Cl. ..... 114/74 A; 220/901
(58) Field of Search ..... 114/74 A, 74 R, 114/74 T; 220/560.04, 560.12, 560.15, 901, 902

(56) References Cited

U.S. PATENT DOCUMENTS

| | | | | | |
|---|---|---|---|---|---|
| 3,112,043 | A | * | 11/1963 | Tucker | 220/560.1 |
| 3,150,793 | A | * | 9/1964 | Messer | 52/309.9 |
| 3,341,049 | A | * | 9/1967 | Forman et al. | 220/560.07 |
| 3,363,796 | A | * | 1/1968 | Pringle | 220/560.07 |
| 3,477,606 | A | * | 11/1969 | Schwendtner | 220/560.07 |
| 3,583,351 | A | * | 6/1971 | Gorman | 114/74 A |
| 3,785,320 | A | | 1/1974 | Bourgeois et al. | |
| 3,896,961 | A | * | 7/1975 | Guilhem et al. | 220/560.15 |
| 3,972,166 | A | * | 8/1976 | Shimomura et al. | 52/404.1 |
| 4,116,150 | A | | 9/1978 | McCown | |
| 4,170,952 | A | | 10/1979 | McCown | |
| 4,199,909 | A | | 4/1980 | Kotcharian | |
| 4,335,831 | A | * | 6/1982 | Swaney | 220/560.12 |
| 5,269,247 | A | * | 12/1993 | Jean | 114/74 A |
| 5,586,513 | A | * | 12/1996 | Jean et al. | 114/74 A |
| 6,035,795 | A | * | 3/2000 | Dhellemmes et al. | 114/74 A |
| 6,145,690 | A | * | 11/2000 | Dhellemmes et al. | 220/560.07 |
| 6,199,497 | B1 | * | 3/2001 | Dhellemmes et al. | 114/74 A |

FOREIGN PATENT DOCUMENTS

| | | |
|---|---|---|
| FR | 1 478 481 | 7/1967 |
| FR | 2 105 710 | 4/1972 |
| FR | 2 386 771 | 11/1978 |
| FR | 2 527 544 | 12/1983 |

* cited by examiner

*Primary Examiner*—S. Joseph Morano
*Assistant Examiner*—Ajay Vasudeva
(74) *Attorney, Agent, or Firm*—Connolly Bove Lodge & Hutz

(57) ABSTRACT

Watertight and thermally insulating tank built into the bearing structure of a ship, said tank comprising two successive watertightness barriers, one being a primary one in contact with the product contained in the tank and the other being a secondary one placed between the primary barrier and the bearing structure, at least one thermally insulating barrier being provided between the bearing structure and the secondary watertightness barrier and/or between the two watertightness barriers, each thermally insulating barrier consisting of a number of caissons (102) of roughly parallelepipedal overall shape, each caisson having a bottom panel (105) and a top panel (106) made of plywood, characterized in that the panels of each caisson are spaced apart by a number of spacer pieces (103) which consist of thin sheets of plywood, extending at right angles to said panels, each caisson being at least partially filled with blocks of foam (104), bonded over a substantial part of the height of each spacer piece, to prevent the spacer pieces from buckling under load.

30 Claims, 3 Drawing Sheets

WATERTIGHT AND THERMALLY INSULATING TANK BUILT INTO THE BEARING STRUCTURE OF A SHIP

The present invention relates to a watertight and thermally insulating tank, particularly for storing a liquefied gas, such as methane, at a temperature of about −160° C., said tank being built into the bearing structure of a ship. The invention also relates to a method of manufacturing thermally insulating caissons intended to be used in this tank.

French patent No 2 527 544 belonging to the current applicant, discloses a watertight and thermally insulating tank built into the bearing structure of a ship, said tank comprising two successive watertightness barriers, one of them a primary one in contact with the product contained in the tank and the other a secondary one located between the primary barrier and the bearing structure, these two watertightness barriers alternating with two thermally insulating barriers known as the primary and secondary insulating barriers each thermally insulating barrier consisting of a number of caissons of roughly parallelepipedal overall shape, each caisson comprising a bottom panel and a top panel made of plywood, side walls and internal partitions, each caisson being filled with a thermally insulating particulate material, for example perlite. However, the use of a powder such as perlite complicates the manufacture of the caissons, because the powder produces dust and it is necessary to use a high-quality and therefore expensive plywood in order to correctly seal the caisson against dust, that is to say to use a plywood which has no knots, and it is necessary to compact the powder at a given pressure in the caisson and it is necessary to pass nitrogen through each caisson to remove all the air present, for safety reasons. All of these operations make manufacture more complicated and increase the cost of the caissons.

It is also known practice, see French patent No 2 724 623, to use insulating caissons consisting of two plywood panels between which is bonded a thermally insulating layer of cellular plastic, such as a polyurethane foam, possibly reinforced with fiberglass fabric inserted into said foam to give it good mechanical properties. The use of a foam avoids the problem associated with the particulate nature of the perlite, and therefore makes it possible to use a lower grade of plywood. By contrast, it is necessary to use a high-density foam, for example one with a density of the order of 120 kg/m$^3$, to guarantee mechanical support of the watertightness barriers subjected to the pressure and movements of the cargo. The fact of using a high-density foam increases its cost and reduces its insulation ability. Thus, it is necessary to increase the thickness of the insulating barrier, which leads to a reduction in the interior tank volume.

The object of the present invention is therefore to propose a tank, the insulating caissons of which do not exhibit the aforementioned drawbacks but which, on the contrary, display good thermal insulation while at the same time being of a simple structure and low cost.

To this end, the subject of the invention is a watertight and thermally insulating tank built into the bearing structure of a ship, said tank comprising two successive watertightness barriers, one being a primary one in contact with the product contained in the tank and the other being a secondary one placed between the primary barrier and the bearing structure, at least one thermally insulating barrier being provided between the bearing structure and the secondary watertightness barrier and/or between the two watertightness barriers, each thermally insulating barrier consisting of a number of caissons of roughly parallelepipedal overall shape, each caisson having a bottom panel and a top panel made of plywood, characterized in that the panels of each caisson are spaced apart by a number of spacer pieces which consist of thin sheets of plywood, for example of the order of 4 mm thick, extending at right angles to said panels, each caisson being at least partially filled with blocks of foam, preferably a low-density foam with a density of the order of 33 to 40 kg/m$_3$, bonded over a substantial part of the height of each spacer piece, to prevent the spacer pieces from buckling under load. By using a low-density foam, the thermal insulation is better, which makes it possible to reduce the thickness of the insulating barrier and therefore increase the interior tank volume. Furthermore, by using spacer pieces of the order of 4 mm thick, instead of the 9 mm internal partitions of the caissons of the prior art, it is possible to reduce the cost of manufacture of the caisson.

By way of example, the parameter $\lambda$ representing the insulation of an insulating caisson is of the order of 0.043 kcal per meter of caisson thickness, per ° C. and per m$^2$ of caisson surface area, for perlite, whereas this parameter $\lambda$ is of the order of 0.030 for a caisson made of a layer of high-density foam sandwiched between two plywood panels, and is of the order of 0.011 to 0.015 for the caisson of the invention. It can thus be seen that, for same thickness, the caisson of the invention is a far better insulator because the heat transfer is lower.

Advantageously, each intermediate space between two spacer pieces of a caisson contains at least one block of foam which is bonded to the walls facing each other on said spacer pieces and extends from one wall to the other.

As a preference, the blocks of foam completely fill the caisson.

According to another feature, the spacer pieces constitute mutually parallel internal partitions of the caisson fixed to said panels at regular intervals. In this case, it is possible to make provision for said partitions to extend over the entire length of the caisson and for the two outermost lateral partitions of the caisson to be spaced from the free edges of the caisson by a half interval filled with foam.

According to yet another feature, the watertightness barriers consist of metal strakes with edges turned up toward the inside of the tank, said strakes being made of thin plate with a low coefficient of expansion and being butt-welded, via their turned-up edges, onto the two faces of a weld flange, for example in the shape of an angle bracket, which is held mechanically on the caissons of the insulating barriers by an expansion joint, said weld flanges being partially engaged in parallel slots, for example T-shaped slots, formed in the top panel of the caissons, the distance between two slots corresponding to the width of a strake, whereas the distance between the free edge of a caisson and the adjacent slot corresponds to the width of half a strake, so that another strake the same width joins two adjacent caissons together.

In this case, it is possible to make provision for the caissons of the primary insulating barrier to have slits through their bottom walls to accommodate, with sliding, the weld flanges of the secondary watertightness barrier, said slits being perpendicular to the spacer pieces of the primary insulating caissons.

In one particular embodiment, each caisson has, at its four corners, a well which passes through the top panel and the blocks of foam, one wall of the well corresponding to one wall of the outermost lateral spacer piece and the bottom of the well consisting of the bottom panel of the caisson, so that the bottom of the well supports laths intended to collaborate with members for fixing the caissons to the bearing structure, the bottom of each well having a recess through the bottom panel for the passage of said fixing members. In this case, the caissons of the insulating barriers are arranged side by side contiguously without any gaps in between, the laths being housed in the wells at each corner of the caissons, without projecting beyond the lateral walls of the caisson.

Advantageously, the members for fixing the secondary insulating barrier to the bearing structure consist of rods, the base of which is screwed into a socket welded to the bearing structure of the ship, said rods passing through the recesses made in the corners of four adjacent secondary caissons, each rod being equipped at its upper part with a mount plate, preferably made of metal, resting against four adjacent laths of four adjacent secondary caissons, placed around said rod, the clamping of the mount plate onto the laths being achieved using a nut which can be screwed onto the threaded upper end of said rod, at least one Belleville washer preferably being inserted between the nut and said mount plate.

In this case, it is possible to make provision for a piece of plywood to be inserted between said mount plate and another mount plate so that said other mount plate lies exactly flush with the level of the top panel of the caissons of the secondary insulating barrier, the two mount plates and the piece of plywood being joined together by screws, the upper mount plate having, at its center, a threaded bore for the fixing of the members for fixing the primary insulating barrier.

As a preference, the strakes of the secondary watertightness barrier which rest against the caissons of the secondary insulating barrier are pierced, in line with said threaded bores so that a threaded base of a connector which has a peripheral rim resting against said strake can be screwed into them, this rim being welded continuously to the strake to restore the watertightness of the secondary watertightness barrier, this rim being extended by another threaded rod, the upper end of which is fitted with a nut for clamping a mount plate against the four adjacent laths of four adjacent caissons of the primary insulating barrier, preferably via at least one Belleville washer.

The invention is also aimed at a method of manufacturing thermally insulating caissons intended to be used in the tank defined hereinabove, characterized in that it consists in stacking, alternately, a number of layers of foam, preferably low density foam, and a number of sheets of plywood, inserting adhesive between each layer of foam and each sheet, until the height of said stack corresponds to the length of said caissons, in cutting the aforementioned stack in slices in the heightwise direction at regular intervals that correspond to the thickness of a caisson, and in bonding onto the edge faces of each slice of stack thus cut, on one side, a bottom panel and on the other side, a top panel made of plywood, said panels extending at right angles to said cut sheets which act as spacer pieces.

For a better understanding of the subject of the invention, one embodiment depicted on the appended drawing will now be described by way of purely illustrative and non limiting example.

Figure 1:
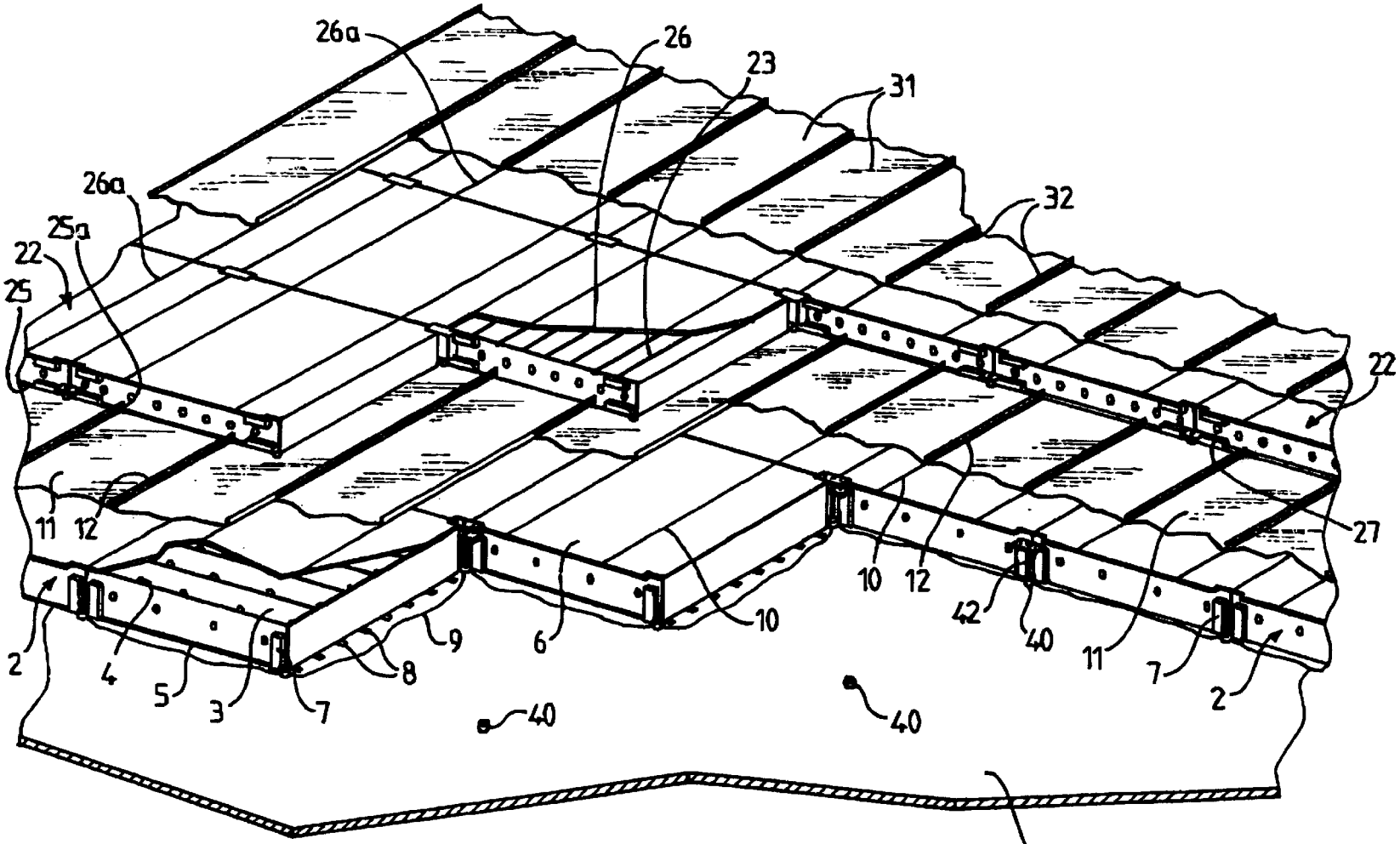
FIG. 1 is a partial perspective view, with cutaway, of a watertight and insulating tank of the prior art.

Referring to FIG. 1, it is possible to see the bearing structure of the ship, which structure in this instance consists of the internal wall 1 of the double hull of the ship. In a way known per se, the tank comprises a secondary insulating barrier fixed to the bearing structure of the ship. This secondary insulating barrier consists of a number of parallelepipedal secondary insulating caissons 2 which are placed side by side, so as to essentially cover the interior surface of the bearing structure. Each secondary insulating caisson 2 consists of a parallelepipedal plywood box which, on the inside, has load bearing partitions 3 and non-bearing partitions 4 which are intended merely to ensure the relative positioning of the bearing partitions 3, said partitions being inserted between a plywood bottom panel 5 and a plywood top panel 6. The bottom wall 5 of the caissons 2 protrudes laterally from the two short sides of the caisson, so that laths 7 which have the thickness of said protruding part are fixed in each corner of the caisson on this protruding part. As will be explained later, the laths 7 collaborate with members for fixing the caissons 2 to the bearing structure. Each caisson 2 is filled with an insulating particulate material, for example perlite. The bottom sheet 5 of each caisson 2 rests on polymerizable resin wads 8 which themselves rest on the bearing structure 1, via a craft paper 9 to prevent the resin of the wad of adhesive from sticking to the bearing structure and thus to allow dynamic deformation of the bearing structure without the caissons 2 experiencing the load due to said deformation. The wads of polymerizable resin 8 are intended to absorb the differences between the theoretical surface intended for the bearing structure and the imperfect surface that is the result of manufacturing tolerances.

Top panels 6 of the secondary insulating caissons 2 further comprise a pair of parallel slots 10 roughly in the shape of an inverted T for housing. bracket-shaped weld flanges. That part of the weld-flanges which protrudes toward the top of the panels 6 is used to anchor the secondary watertightness barrier. The secondary watertightness barrier consists of a number of Invar strakes 11 with turned-up edges 12, having a thickness of the order of 0.7 mm. The turned-up edges 12 of each strake 11 are welded to the aforementioned weld flanges.

Mounted on the secondary watertightness barrier is the primary insulating barrier which also consists of a number of primary insulating caissons 22 with a structure similar to the secondary insulating caissons 2. Each primary insulating caisson 22 consists of a right-angled parallelepipedal box made of plywood and not as tall as the caisson 2, and which is filled with particulate material, such as perlite. The primary insulating caissons 22 also comprise load-bearing internal partitions 23, a bottom panel 25 and a top panel 26. The bottom panel 25 has two longitudinal slots 25*a* intended to house the weld flanges and the turned-up edges 12 of the secondary watertightness barrier. The top panels 26, for their part, comprise two slots 26*a*, in the overall shape of an inverted T, to also accommodate a weld flange (not depicted) to which the turned-up edges 32 of the strakes 31 of the primary watertightness barrier are welded. It can be seen that the separation between two slots 10, 25*a* or 26*a* of one and the same caisson 2 or 22 corresponds to the width of a strake 11 or 31, and that the separation between the slots and the adjacent edge of said caisson corresponds to half of the width of a strake, so that a strake overlaps two adjacent caissons.

Furthermore, the primary insulating caissons 22 have a bottom panel 25 which protrudes on its small sides so that laths 27 rest against the protruding part of the bottom panel to collaborate with fixing members, as explained later on.

Figure 2:
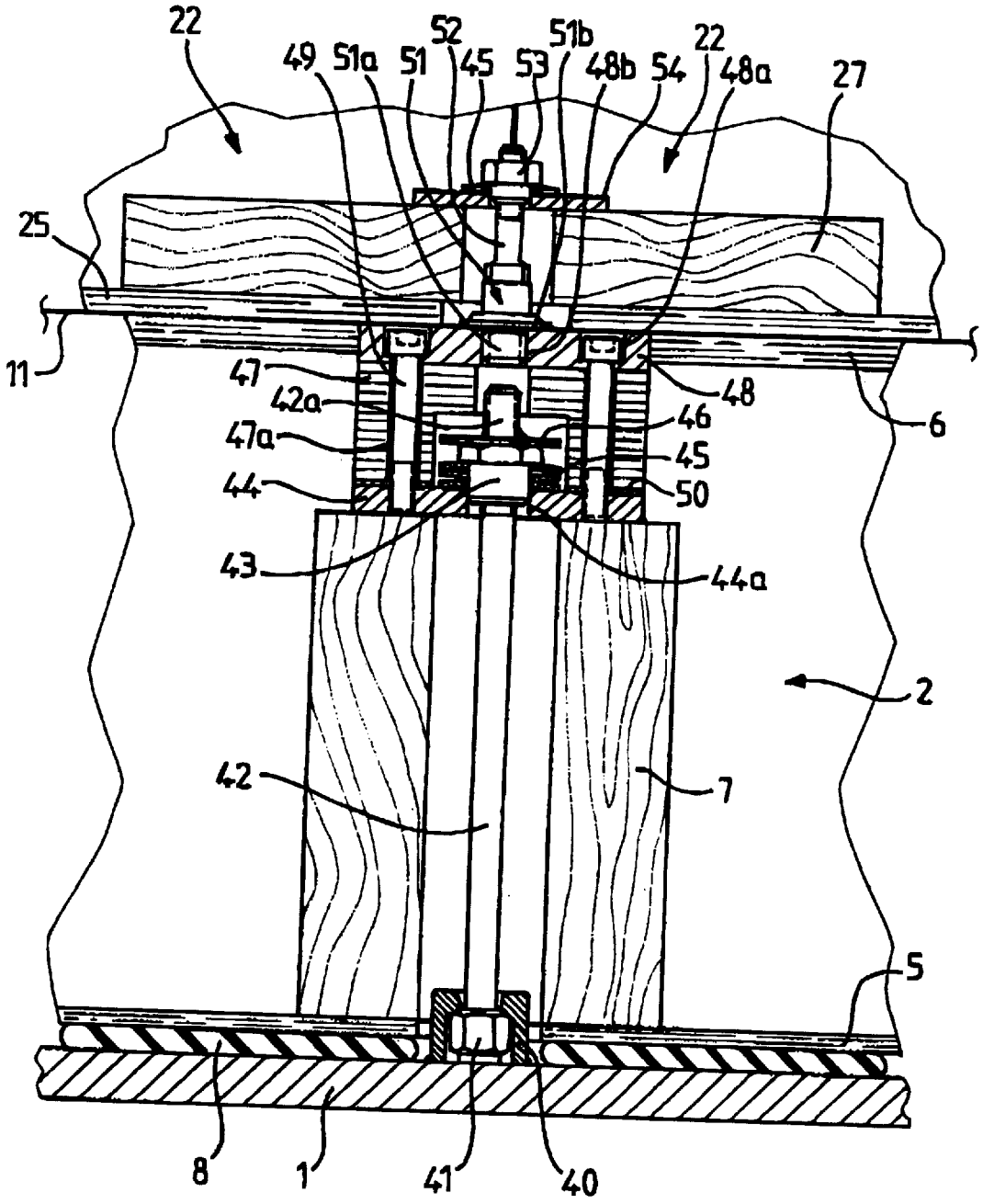
FIG. 2 is a partial view in section perpendicular to the bearing structure of the ship, at the location of the primary and secondary insulating barrier caisson fastening members, for the tank of FIG. 1.

With reference now to FIG. 2, the members for fixing the primary and secondary insulating barriers to the bearing structure will now be described. These fixing members comprise sockets 40, the base of which is welded to the bearing structure 1 at positions which precisely correspond to the corners of each secondary insulating caisson 2. Each socket 40 contains a nut 41 which rotates integrally with it, so that a first rod 42 can be screwed by its threaded lower end into the nut 41 and via its threaded upper end into another nut 43. As a preference, the nut-41/socket-40 bearing surface is of the frustoconical/spherical bearing surface type, to reduce the thermal bridge between the temperature of the internal wall 1 of the double hull of the ship and that of the fixing members.

The rod 42 passes between the adjacent caissons 2 so that the intermediary spaces between the caissons need to be filled with glass wool wadding to ensure the continuity of the secondary insulating barrier. The upper nut 43 passes through an orifice 44*a* in a metal mount plate 44 and has a radially protruding upper rim to clamp said plate 44 against the aforementioned laths 7. Inserted between the rim of the nut 43 and the plate 44 are a number of Belleville washers 45. It can be seen in FIG. 2 that the threaded upper end 42*a* of the rod 42 projects beyond the nut 43. To fix the nut 43 in position on the threaded rod 42, a locking washer 46 is welded locally to the threaded upper end 42*a* . A piece of plywood 47 is mounted on the plate 44 to act as a spacing piece between said plate 44 and another upper plate 48. The piece of wood 47 has a housing intended to house the rod 42 and its nut 43, and two holes 47*a* intended for the passage of fixing screws 49. The head of each fixing screw 49 rests in a spot face 48*a* made in the upper plate 48. The height of the piece of wood 47 and of an intermediate shimming piece 50 is determined so that the upper plate 48 lies flush with the top panels 6 of the secondary insulating caissons 2.

The upper plate 48 further has a central threaded bore 48*b* intended to accommodate a threaded base 51*a* of a connector 51. The threaded base 51*a* also passes through a hole made through a strake 11 of the secondary watertightness barrier, said connector comprising a rim 51*b* which is welded at its periphery to the strake 11 around said hole to restore the watertightness of the secondary watertightness barrier. The connector 51 is continued by an upper rod 52 which screws into an upper nut 53 to clamp a metal platelet 54 onto the laths 27 of the primary insulating caissons 22. One or more Belleville washers 45 may also be inserted between the upper nut 53 and the platelet 54. Here again, it is necessary to fill the intermediary space between the faces of the primary insulating caissons 22 which are fitted with the laths 27 with a glass wool wadding to ensure the continuity of the primary insulating barrier.

Figure 4:
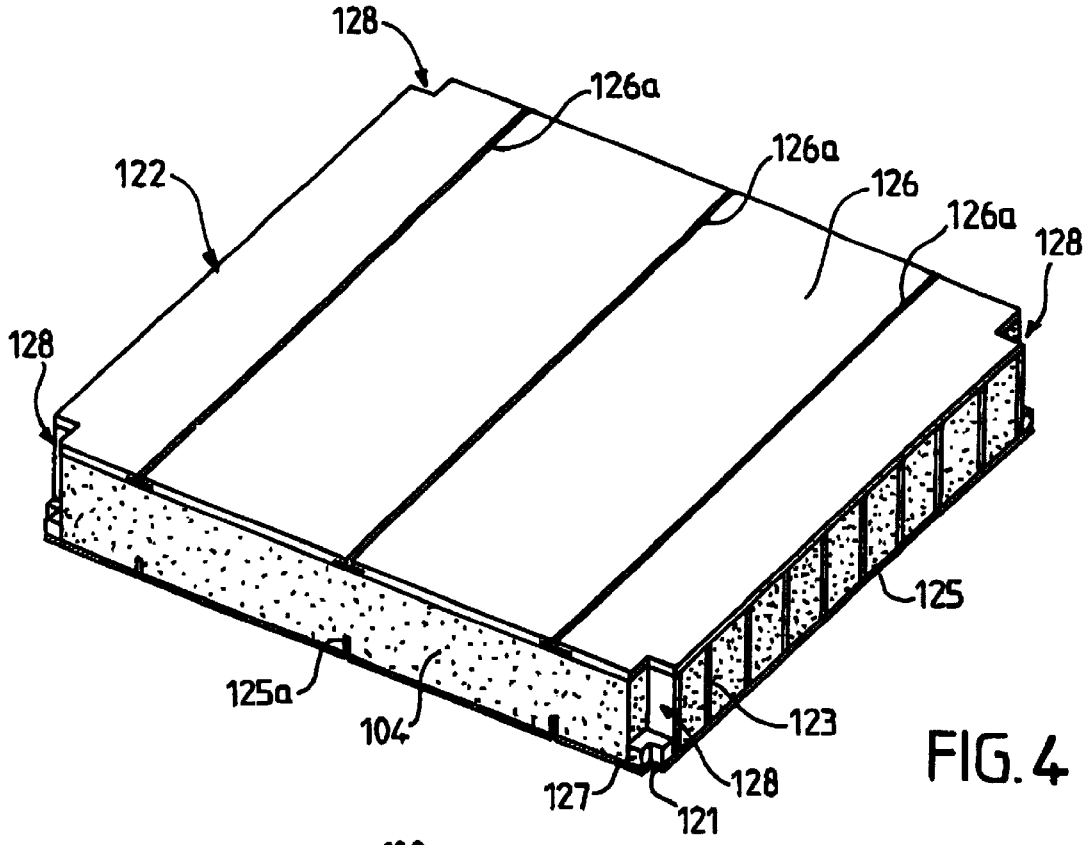
FIG. 4 is a perspective view of a caisson of the primary insulating barrier of the tank of the invention.
Figure 3:
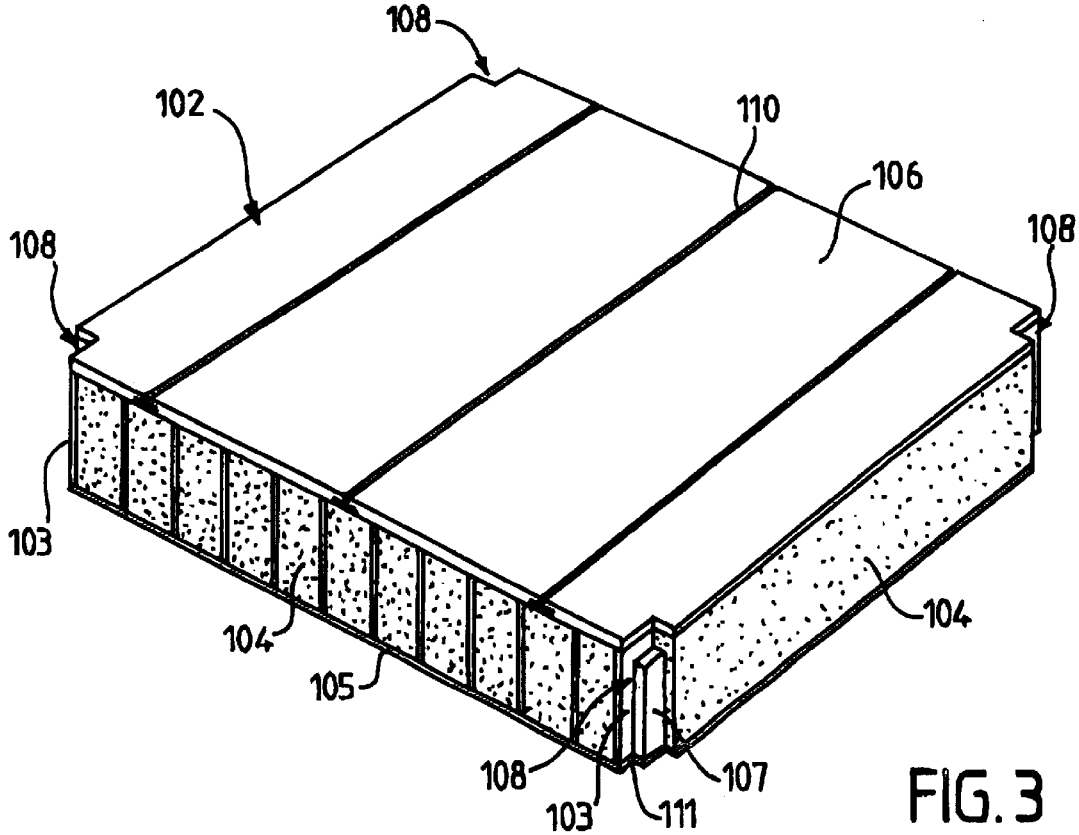
FIG. 3 is a perspective view of a caisson of the secondary insulating barrier of the tank of the invention.

The invention consists simply in replacing the aforementioned caissons 2 and 22 with the caissons 102 and 122 illustrated respectively in FIGS. 3 and 4.

In FIG. 3, it can be seen that the secondary insulating caisson 102 also has a bottom wall 105 and a top wall 106, the latter having three slots 110 with a cross section in the shape of an inverted T to house the bracket-shaped weld flanges. This caisson 102 may, for example, be 1.5 mn long by 1.2 mn wide with a height of 0.3 mn. The thickness of the bottom panel 105 may be of the order of 6.5 mm, while the thickness of the top panel 106 may be of the order of 12 mm, so that the slots 110 can be made therein. Between the two panels 105 and 106, the caisson 102 has a number of spacer pieces 103, all mutually parallel and all, for example, 4 mm thick, extending in the widthwise direction of the caisson 102. The partitions 103 extend across the entire width of the caisson 102 and are uniformly spaced in the lengthwise direction by an interval of the order of 125 mm, the two outermost lateral spacer pieces being spaced away from the adjacent short side of the caisson by a half interval. The intermediary spaces between the spacer pieces 103 and the empty spaces between the outermost lateral spacer pieces and the short sides of the caisson 102 are filled with a polyurethane foam 104 with a density of 40 $kg/m_3$ or less.

The caissons 102 further comprise, at each corner, a well 108 of rectangular cross section, one side of which is formed by a portion of a partition 103, another side of which is formed by a portion of foam 104, and the other two sides of which are open. Each well 108 passes through the top panel 106 and the thickness of the foam 104 down to the bottom panel 105. A lath 107 of rectangular cross section rests against the bottom of the well 108 defined by the bottom panel 105. However, the portion of the bottom panel 105 which is not used to support the lath 107, is cut out to define a recess 111 for the passage of the aforementioned socket 40 and of the aforementioned rod 42 of the fixing members. The way in which the caisson 102 is anchored is identical to that of the panel 2, except that here there is no intermediary space between the adjacent caissons 102, which may be contiguous, making it possible to dispense with the glass wool wadding.

Referring now to FIG. 4, it may be seen that the primary insulating caisson 122 also has internal spacer pieces 123, a bottom panel 125, a top panel 126, the latter having three slots 126*a* with cross sections in the shape of an inverted T. The bottom panel 125, and a lower part of the foam 104 and of the partitions 123 having, passing through them, transverse slits 125*a* intended to house the weld flanges and the turned-up edges of the secondary watertightness barrier. The spacer pieces 123 here extend in the lengthwise direction of the caisson 122. The dimensions of the caisson 122 are, incidentally, identical to those of the caisson 102. The caisson 122 also has, at each corner, a well 128 in which there is housed a lath 127 of bracket-shaped cross section resting against the bottom of the well 128 as defined by the bottom panel 125. The lath 127 is markedly less tall than the lath 107. Specifically, the lath 107 extends over most of the height of the foam 104.

In fact, only the wells 108 and 128 need to be filled with a plug of insulating material, for example a plug of polyurethane foam with a density of 120 $kg/m^3$. The fixing members presented in FIG. 2 pass through the recesses 111 in the bottom plate 105 of the secondary caisson 102 and through the recesses 121 in the bottom panel 125 of the primary caisson 122.

By virtue of the foam 104 bonded to them, the internal partitions 103 and 123 work only in compression rather than in buckling.

Although the invention has been described in conjunction with a number of particular alternative forms of embodiment, it is quite obvious that it is not in any way restricted thereto and that it comprises all technical equivalents of the means described and combinations thereof where these fall within the scope of the invention.

What is claimed is:

1. Watertight and thermally insulating tank built into a bearing structure of a ship, said tank comprising two successive watertightness barriers, one being a primary watertightness barrier in contact with the product contained in the tank and the other being a secondary watertightness barrier placed between the primary barrier and the bearing structure, at least one thermally insulating-barrier being provided between the bearing structure and the secondary watertightness barrier or between the two watertightness barriers, each at least one thermally insulating-barrier comprising a number of caissons of roughly parallelepipedal overall shape, each caisson comprising a bottom panel and a top panel made of plywood, wherein the panels of each caisson are spaced apart by a number of spacer pieces comprising thin sheets of plywood, extending at right angles to said panels, each caisson being at least partially filled with blocks of foam bonded over a substantial part of the height of each spacer piece, to prevent the spacer pieces from buckling under load.

2. Tank according to claim 1, wherein each intermediate space between two spacer pieces of a caisson contains at least one block of foam which is bonded to the walls facing each other on said spacer pieces and extends from one wall to the other.

3. Tank according to claim 2, wherein the blocks of foam completely fill the caisson.

4. Tank according to claim 3, wherein the spacer pieces constitute mutually parallel internal partitions of the caisson fixed to said panels at regular intervals.

5. Tank according to claim 3, wherein the watertightness barriers comprise metal strakes with edges turned up toward the inside of the tank, said strakes being made of thin plate with a low coefficient of expansion and being butt-welded, via their turned-up edges, onto the two faces of a weld flange, which is held mechanically on the caissons of the insulating barriers by an expansion joint, said weld flanges being partially engaged in parallel slots, formed in the top panel of the caissons, the distance between two slots corresponding to the width of a strake, whereas the distance between the free edge of a caisson and the adjacent slot corresponds to the width of half a strake, so that another strake the same width joins two adjacent caissons together.

6. Tank according to claim 2, wherein the spacer pieces constitute mutually parallel internal partitions of the caisson fixed to said panels at regular intervals.

7. Tank according to claim 2, wherein the watertightness barriers comprise metal strakes with edges turned up toward the inside of the tank, said strakes being made of thin plate with a low coefficient of expansion and being butt-welded, via their turned-up edges, onto the two faces of a weld flange, which is held mechanically on the caissons of the insulating barriers by an expansion joint, said weld flanges being partially engaged in parallel slots, formed in the top panel of the caissons, the distance between two slots corresponding to the width of a strake, whereas the distance between the free edge of a caisson and the adjacent slot corresponds to the width of half a strake, so that another strake the same width joins two adjacent caissons together.

8. Tank according to claim 7, wherein the strakes are butt-welded in the shape of an angle bracket.

9. Tank according to claim 7, wherein the parallel slots are T-shaped.

10. Tank according o claim 2, wherein each caisson has, at its four corners, a well which passes through the top panel and the blocks of foam, one wall of the well corresponding to one wall of the outermost lateral spacer piece and the bottom of the well consisting of the bottom panel of the caisson, so that the bottom of the well supports laths intended to collaborate with members for fixing the caissons to the bearing structure, the bottom of each well having a recess through the bottom panel for the passage of said fixing members.

11. Tank according to claim 1, wherein the spacer pieces constitute mutually parallel internal partitions of the caisson fixed to said panels at regular intervals.

12. Tank according to claim 11, wherein said partitions extend over the entire length of the caisson and in that the two outermost lateral partitions of the caisson are spaced from the free edges of the caisson by a half-interval filled with foam.

13. Tank according to claim 12, wherein the watertightness barriers comprise metal strakes with edges turned up toward the inside of the tank, said strakes being made of thin plate with a low coefficient of expansion and being butt-welded, via their turned-up edges, onto the two faces of a weld flange, which is held mechanically on the caissons of the insulating barriers by an expansion joint, said weld flanges being partially engaged in parallel slots, formed in the top panel of the caissons, the distance between two slots corresponding to the width of a strake, whereas the distance between the free edge of a caisson and the adjacent slot corresponds to the width of half a strake, so that another strake the same width joins two adjacent caissons together.

14. Tank according to claim 11, wherein the watertightness barriers comprise metal strakes with edges turned up toward the inside of the tank, said strakes being made of thin plate with a low coefficient of expansion and being butt-welded, via their turned-up edges, onto the two faces of a weld flange, which is held mechanically on the caissons of the insulating barriers by an expansion joint, said weld flanges being partially engaged in parallel slots, formed in the top panel of the caissons, the distance between two slots corresponding to the width of a strake, whereas the distance between the free edge of a caisson and the adjacent slot corresponds to the width of half a strake, so that another strake the same width joins two adjacent caissons together.

15. Tank according to claim 1 wherein the watertightness barriers comprise metal strakes with edges turned up toward the inside of the tank, said strakes being made of thin plate with a low coefficient of expansion and being butt-welded, via their turned-up edges, onto the two faces of a weld flange which is held mechanically on the caissons of the insulating barriers by an expansion joint, said weld flanges being partially engaged in parallel slots, formed in the top panel of the caissons, the distance, between two slots corresponding to the width of a strake, whereas the distance between the free edge of a caisson and the adjacent slot corresponds to the width of half a strake, so that another strake the same width joins two adjacent caissons together.

16. Tank according to claim 15, wherein the at least one thermally insulating barrier comprises a primary thermally insulating barrier and the caissons of the primary insulating barrier have slits through their bottom walls to accommodate, with sliding, the weld flanges of the secondary watertightness barrier, said slits being perpendicular to the spacer pieces of the caissons of the primary watertightness barrier.

17. Tank according to claim 15, wherein the weld flange is in the shape of an angle bracket.

18. Tank according to claim 1, wherein each caisson has, at its four corners, a well which passes through the top panel and the blocks of foam, one wall of the well corresponding to one, wall of the outermost lateral spacer piece and the bottom of the well comprising the bottom panel of the caisson, so that the bottom of the well supports laths intended to collaborate with members for fixing the caissons to the bearing structure of the ship, the bottom of each well having a recess through the bottom panel for the passage of said fixing members.

19. Tank according to claim 18, wherein the caissons of the at least one thermally insulating barrier are arranged side by side contiguously without any gaps in between, the laths being housed in the wells at each corner of the caissons, without projecting beyond the lateral walls of the caisson.

20. Tank according to claim 18, wherein the at least one thermally insulating barrier further comprises a secondary thermally insulating barrier and the members for fixing the secondary insulating barrier to the bearing structure comprise rods, the base of which is screwed into a socket welded to the bearing structure of the ship, said rods passing through the recesses made in the corners of four adjacent secondary caissons, each rod being equipped at its upper part with a mount plate resting against four adjacent laths of four adjacent secondary caissons, placed around said rod, the clamping of the mount plate onto the laths being achieved using a nut which can be screwed onto the threaded upper end of said rod, and at least one Belleville washer.

21. Tank according to claim 20, Wherein a piece of plywood is inserted between said mount plate and another mount plate that said other mount plate lies exactly flush with the level surface of the top panel of the caissons of the secondary insulating barrier, the two mount plates and the piece of plywood being joined together by screws, the upper mount plate having, at its center, a threaded bore for the fixing of the members for fixing the primary insulating barrier.

22. Tank according to claim 21, wherein the strakes of the secondary watertightness barrier which rest against the caissons of the secondary insulating barrier are pierced, in line with said threaded bores so that a threaded base of a connector which has a peripheral rim resting against said strake can be screwed into them, this rim being welded continuously to the strake to restore the watertightness of the secondary watertightness barrier, this rim being extended by another threaded rod, the upper end of which is fitted with a nut for clamping a mount plate against the four adjacent laths (127) of four adjacent caissons (122) of the primary insulating barrier.

23. Tank according to claim 20, wherein the mount plate is made of metal.

24. Tank according to claim 20, wherein the Belleville washer is inserted between the nut and said mount plate.

25. Tank according to claim 1, wherein the watertightness barriers comprise metal, strakes.

26. Tank according to claims 25, wherein the strakes have a thickness of about 7 mm.

27. Tank according to claim 1, further comprising at least one thermally insulating barrier being provided between the bearing structure and the secondary watertightness barrier and between the two watertightness barriers.

28. Tank according to claim 1, wherein the sheets of plywood are about 4 mm thick.

29. Tank according to claim 1, wherein the foam has a density of the order of about 33 to 40 $kg/m^3$.

30. Watertight and thermally insulating tank built into a bearing structure of a ship, said tank comprising two successive watertightness barriers, one being a primary watertightness barrier in contact with the product contained in the tank and the other being a secondary watertightness barrier placed between the primary barrier and the bearing structure, at least one thermally insulating barrier being provided between the bearing structure and the secondary watertightness barrier or between the two watertightness barriers, each thermally insulating barrier comprising a number of caissons of roughly parallelepipedal overall shape, each caisson comprising a bottom panel and a top panel made of plywood, wherein the panels of each caisson are spaced apart by a number of spacer pieces comprising thin sheets of plywood, thinner than the bottom panel or the top panel of the caisson, extending at right angles to said panels, each caisson being at least partially filled with blocks of foam bonded over a substantial part of the height of each spacer piece, to prevent the spacer pieces from buckling under load.

* * * * *